US010033136B2

(12) United States Patent
Humbert

(10) Patent No.: US 10,033,136 B2
(45) Date of Patent: Jul. 24, 2018

(54) STRAIN RELIEF ASSEMBLY FOR CONDUCTIVE CABLES

(71) Applicant: FCI USA LLC, Etters, PA (US)

(72) Inventor: David Humbert, Etters, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/505,410

(22) PCT Filed: Aug. 20, 2015

(86) PCT No.: PCT/US2015/046039
§ 371 (c)(1),
(2) Date: Feb. 21, 2017

(87) PCT Pub. No.: WO2016/028977
PCT Pub. Date: Feb. 25, 2016

(65) Prior Publication Data

US 2017/0279219 A1 Sep. 28, 2017

Related U.S. Application Data

(60) Provisional application No. 62/040,004, filed on Aug. 21, 2014.

(51) Int. Cl.

| | |
|---|---|
| ***H01R 12/79*** | (2011.01) |
| ***H01R 43/20*** | (2006.01) |
| ***H01R 13/595*** | (2006.01) |
| ***H01R 13/58*** | (2006.01) |

(52) U.S. Cl.
CPC ..... *H01R 13/595* (2013.01); *H01R 13/5808* (2013.01)

(58) Field of Classification Search
CPC .... H01R 13/6658; H01R 12/79; H01R 12/62; H01R 43/28; H01R 43/20; H01R 43/02; H01R 43/0207
USPC ..... 439/76.1, 77, 493; 29/857, 860, 854
See application file for complete search history.

(56) References Cited

U.S. PATENT DOCUMENTS 4,871,319 A * 10/1989 Babow ..... H01R 12/62 439/493
5,580,271 A * 12/1996 Buchheister, Jr. ... B23K 1/0016 439/493
6,190,196 B1 * 2/2001 Kato ..... H01R 12/772 439/493

(Continued)

FOREIGN PATENT DOCUMENTS

WO WO 2012-001161 1/2012

OTHER PUBLICATIONS

International Search Report and Written Opinion for International Application No. PCT/US2015/046039 dated Oct. 15, 2015.

(Continued)

*Primary Examiner* — Gary Paumen
(74) *Attorney, Agent, or Firm* — Wolf, Greenfield & Sacks, P.C.

(57) ABSTRACT

A strain relief assembly is provided for a bundle of cables surrounded by an electrically conductive sleeve. The strain relief assembly can include a ferrule and at least one retention member. The cables extend through the ferrule, and the sleeve extends over the ferrule, so as to be captured between the ferrule and the retention member.

29 Claims, 5 Drawing Sheets

(56) References Cited

U.S. PATENT DOCUMENTS

| | | | | |
|---|---|---|---|---|
| 8,303,314 | B2 * | 11/2012 | Wu | H01R 9/032 29/860 |
| 8,435,074 | B1 | 5/2013 | Grant et al. | |
| 9,257,778 | B2 * | 2/2016 | Buck | H01R 13/516 |
| 2011/0086548 | A1 | 4/2011 | Wu | |

OTHER PUBLICATIONS

International Preliminary Report on Patentability for International Application No. PCT/US2015/046039 dated Mar. 2, 2017.

* cited by examiner 20
22
23
24
38
80
80a
80b
81
82
83
84
85
86
87
88
60
56
62
32
29
31
34
36
T
A
L

STRAIN RELIEF ASSEMBLY FOR CONDUCTIVE CABLES

RELATED APPLICATIONS

The present application is a U.S. national stage filing under 35 U.S.C. § 371 based on International Application No. PCT/US2015/046039 entitled "STRAIN RELIEF ASSEMBLY FOR CONDUCTIVE CABLES", filed Aug. 20, 2015, which claims priority under 35 U.S.C. § 119(e) to U.S. Provisional Patent Application No. 62/040,004, filed Aug. 21, 2014. The entire contents of the foregoing are hereby incorporated herein by reference.

BACKGROUND

Electrical systems can include an electrical component and a plurality of conductive cables that extend out from the electrical component. Examples of electrical components can include electrical connectors and optical transceivers. The conductive cables can be bundled together, and surrounded by a sleeve. It is desired to secure the sleeve such that strain relief is provided to the conductive cables.

SUMMARY

In accordance with one embodiment, an electrical connector module can include an electrical component having a mating end and a mounting end, and a bundle of conductive cables that extend out from the mounting end along a length. The electrical connector module can further include a ferrule disposed between the bundle and the electrically conductive sleeve, such that the bundle extends through the ferrule. The electrical connector module can further include an electrically conductive sleeve that surrounds the bundle along at least a portion of the length, and further overlaps at least a portion of the ferrule at a region of overlap. The electrical connector module can further include at least one retention member that is positioned at the region of overlap, such that the electrically conductive sleeve extends to a location between the ferrule and the at least one retention member at the region of overlap. The at least one retention member can be compressed toward the ferrule so as to apply a compressive retention force to the electrically conductive sleeve between the ferrule and the at least one retention member.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
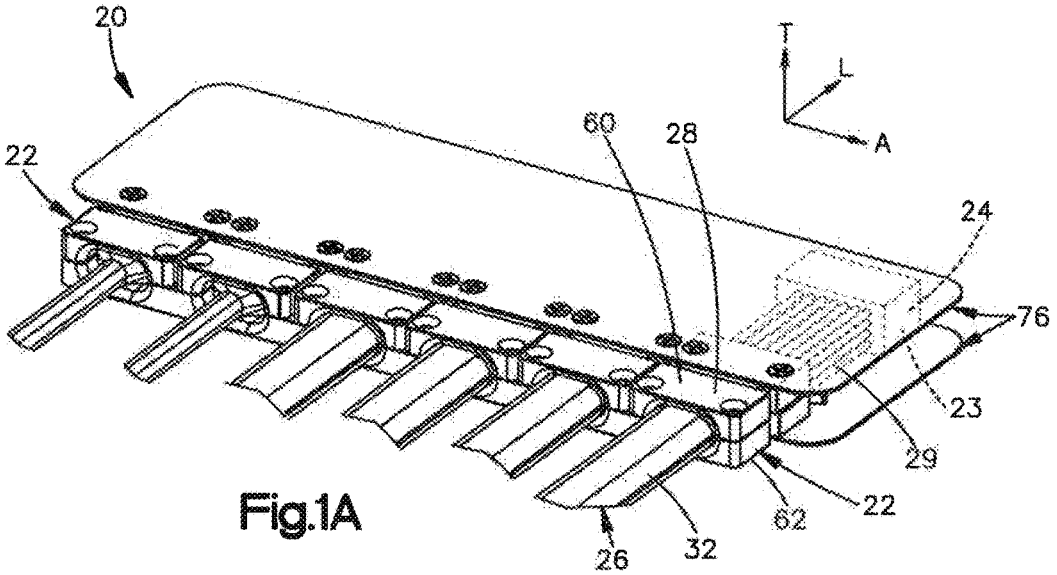
FIG. 1A is a perspective view of an electrical connector system including a plurality of electrical connector modules secured to a ground.
Figure 1B:
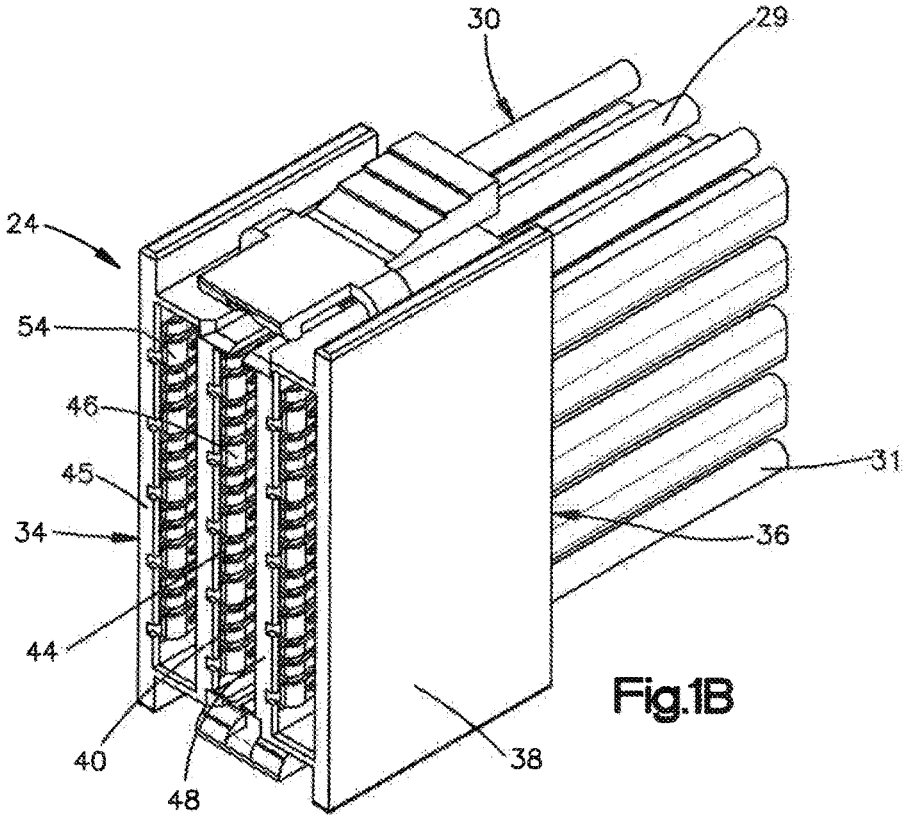
FIG. 1B is a perspective view of a representative electrical connector of the connector modules illustrated in FIG. 1A.

Referring initially to FIGS. 1A-1B, an electrical connector system 20 can include at least one electrical connector module 22. For instance, the electrical connector system 20 can include a plurality of electrical connector modules 22. Each of the electrical connector modules 22 can include an electrical component 23 that can be configured as an electrical connector 24 or any suitable alternatively constructed electrical component. Each of the electrical connector modules 22 can further include at least one cable assembly 26 that, in turn, can include a plurality of conductive cables 29. The electrical component 23 can be mounted to the conductive cables 29 as described in more detail below. The cable assembly 26 can be elongate along a longitudinal direction L. The longitudinal direction L can be straight or curved as desired. The conductive cables 29 can be made from any suitable electrically conductive material, so as to define electrically conductive cables. For instance, the electrically conductive material can be copper. Alternatively, the conductive cables 29 can be made from any suitable optically conductive material. Thus, the conductive cables 29 can be optically conductive cables. For instance, the conductive cables 29 can be fiber optic cables.

The cable assembly 26 can include an electrically conductive sleeve 32 that surrounds the conductive cables 29 with respect to a radial direction that is perpendicular to the longitudinal direction L. For instance, the conductive cables 29 can be bundled together so as to define a bundle 30 of conductive cables 29 that extends out from the electrical component 23. The electrically conductive sleeve 32 can surround the bundle 30. In one embodiment, the electrically conductive sleeve 32 can surround the bundle along at least a portion of its length up to an entirety of its length. The electrically conductive sleeve 32 can be flexible. For instance, the electrically conductive sleeve 32 can be defined by woven electrically conductive fibers. In one example, the electrically conductive sleeve 32 can define a braid. The electrically conductive fibers can be metallic. Each of the electrically conductive sleeves 32 can define a shield that reduces electrical interference between the bundle 30 of conductive cables 29 of a first one of the electrical connector modules 22 and the bundle 30 of conductive cables 29 of a second one of the electrical connector modules 22. The first and second ones of the electrical connector modules 22 can be positioned adjacent each other, or located in any relative proximity with respect to each other as desired.

Each of the plurality of conductive cables 29 can include at least one electrical conductor, such as a pair of electrical conductors, and an electrical insulator 31 that surrounds the at least one electrical conductor. At least one of the at least one electrical conductor can be configured as an electrical signal carrying conductor as desired. At least one of the at least one electrical conductor can be configured as an electrical ground conductor. In one example, each of the electrical insulators 31 can surround a pair of electrical signal conductors and a drain wire. The electrical signal conductors can be mounted to the mounting ends of electrical signal contacts 44 of the electrical connector 24. The electrical signal conductors surrounded by a common one of the electrical insulators 31 can defining a differential signal pair. Alternatively, the electrical signal conductors can be single ended as desired. The drain wire can be mounted to ground mounting ends of electrical connector 24. The electrical insulators 31 of each cable can reduce the crosstalk imparted by one of the electrical signal carrying conductors of the cable assembly 26 to another of the electrical signal carrying conductors of the cable assembly 26.

It will be appreciated that the electrical connector 24 can be constructed in accordance with any suitable embodiment as desired. For instance, the electrical connector 24 can be configured to be mounted to the plurality of cables 29 so as to be placed in electrical communication with the plurality of cables 29, thereby defining a cable assembly that includes the electrical connector 24 mounted to the plurality of cables 29. The electrical connector 24 can be constructed as a vertical electrical connector that defines a mating interface 34 and a mounting interface 36 that is oriented substantially parallel to the mating interface 34. It should be appreciated, of course, that the electrical connector 24 can alternatively be configured as a right-angle connector whereby the mating interface 34 is oriented substantially perpendicular with respect to the mounting interface 36. The electrical connector 24 is configured to attach to the conductive cables 29 at the mounting interface 36, and is configured to mate with a complementary electrical component, such as a complementary electrical connector, at the mating interface 34, thereby placing the complementary electrical component in communication with the conductive cables 29.

The electrical connector 24 can include a dielectric, or electrically insulative connector housing 38 and a plurality of electrical contacts 40 that are supported by the connector housing 38. The electrical contacts 40 define mating ends and mounting ends opposite the mating ends. The mounting ends are configured to be mounted to respective ones of the plurality of conductive cables 29, thereby placing the electrical contacts 40 in electrical communication with the respective ones of the conductive cables 29. The plurality of electrical contacts 40 can include respective pluralities of signal contacts 44 and ground contacts 46. The electrical connector 24 can include a plurality of leadframe assemblies 48 that are supported by the connector housing 38.

Each leadframe assembly 48 can include a respective dielectric, or electrically insulative, leadframe housing, and respective ones of the plurality of electrical contacts 40 that are supported by the leadframe housing. For instance, each leadframe assembly 48 can include a respective plurality of electrical signal contacts 44 and at least one ground contact 46. The electrical signal contacts 44 can define mating ends 45 and mounting ends opposite the mating ends 45. The electrical contacts of each leadframe assembly can further include an electrically conductive ground retention plate that can define a ground contact having a plurality of ground mating ends 54 and ground mounting ends opposite the ground mating ends 54. The mating ends 45 of the signal contacts 44 and the ground mating ends 54 can be positioned along the mating interface 34, and the mounting ends of the signal contacts 44 and the ground mounting ends can be positioned along the mounting interface 36. At least one or more of the ground mating ends 54 can be positioned between adjacent pairs of mating ends 45 of the electrical signal contacts 44. The pairs of mating ends 45 can be arranged along a column direction defined by each of the leadframe assemblies 48. The pairs of mating ends 45 can define differential signal pairs. Alternatively, the pairs of mating ends 45 can be single ended.

The mounting ends of the electrical signal contacts 44 can be mounted to respective ones of the plurality of conductive cables 29, thereby placing the mounting ends of the electrical signal contacts 44 in electrical communication with the respective ones of the plurality of conductive cables 29. The ground mounting ends can be mounted to respective ones of the plurality of conductive cables 29, thereby placing the ground mounting ends in electrical communication with the respective ones of the plurality of conductive cables 29. Thus, in one embodiment, the respective ones of the conductive cables mounted to the ground mounting ends can be in electrical communication with the ground retention plate. Alternatively, the electrical connector can include a plurality of individual ground contacts that define the respective ground mating ends 54 and ground mounting ends. Thus, the respective ones of the conductive cables mounted to the ground mounting ends can be in electrical communication with respective ones of the individual electrical ground contacts. Each leadframe assembly 48 can further include a compression shield that is configured to be attached to the leadframe housing so as to compress exposed portions of the electrical insulators 31 of the conductive cables 29 into contact with the ground retention plate. The compression shield can further be configured to isolate each conductive cable from each other electrical cable of the plurality of conductive cables 29.

The electrical connector 24 can be constructed as described in U.S. patent application Ser. No. 13/836,610 filed Mar. 15, 2013, the disclosure of which is hereby incorporated by reference as if set forth in its entirety herein. Alternatively, the electrical connector 24 can be constructed in accordance with any suitable embodiment. As one example, the electrical connector module 22 can be configured as an SFP or SFP+ electrical transceiver module, or any suitable alternative device, such as a QSFP+, CXP, mini-SAS module including a mini-SAS connector module. Thus, the electrical connector module 22 can include the electrical component having mating ends and mounting ends. The electrical contacts of the electrical component 23 can be defined be individual electrical contacts that include ground contacts and signal contacts. Alternatively, the electrical contacts can include individual signal contacts and a ground retention plate. Alternatively still, the electrical contacts can be defined by electrical traces of one or more printed circuit boards of the electrical component 23.

Figure 1C:
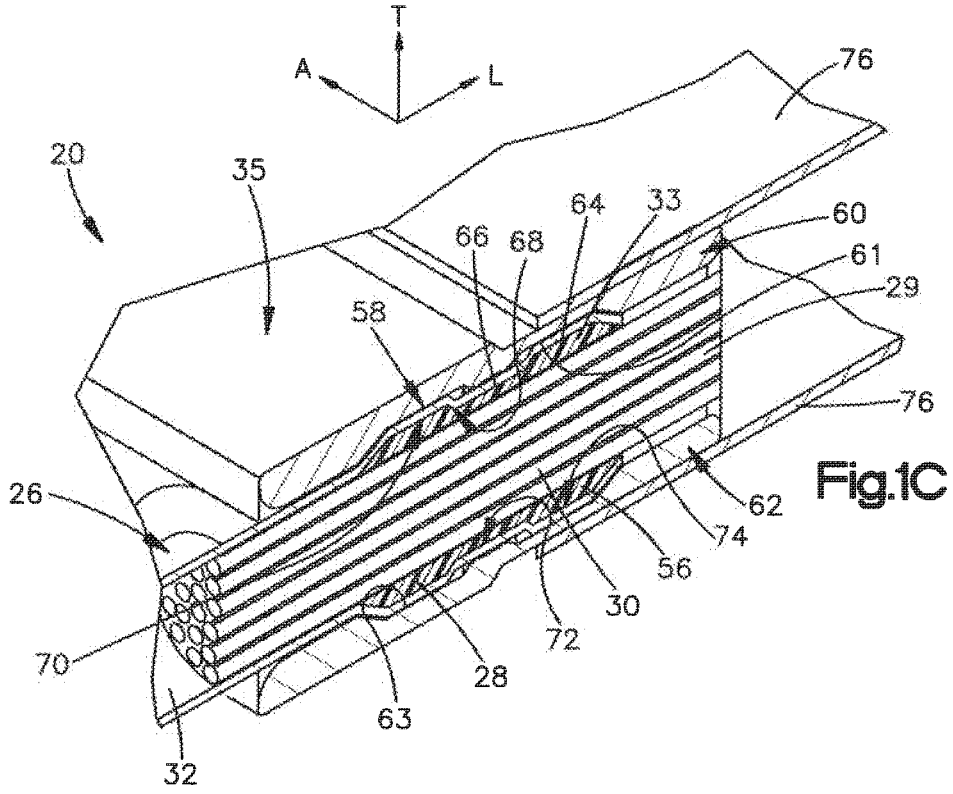
FIG. 1C is a sectional side elevation view of a strain relief assembly of the electrical connector module illustrated in FIG. 1A.
Figure 1D:
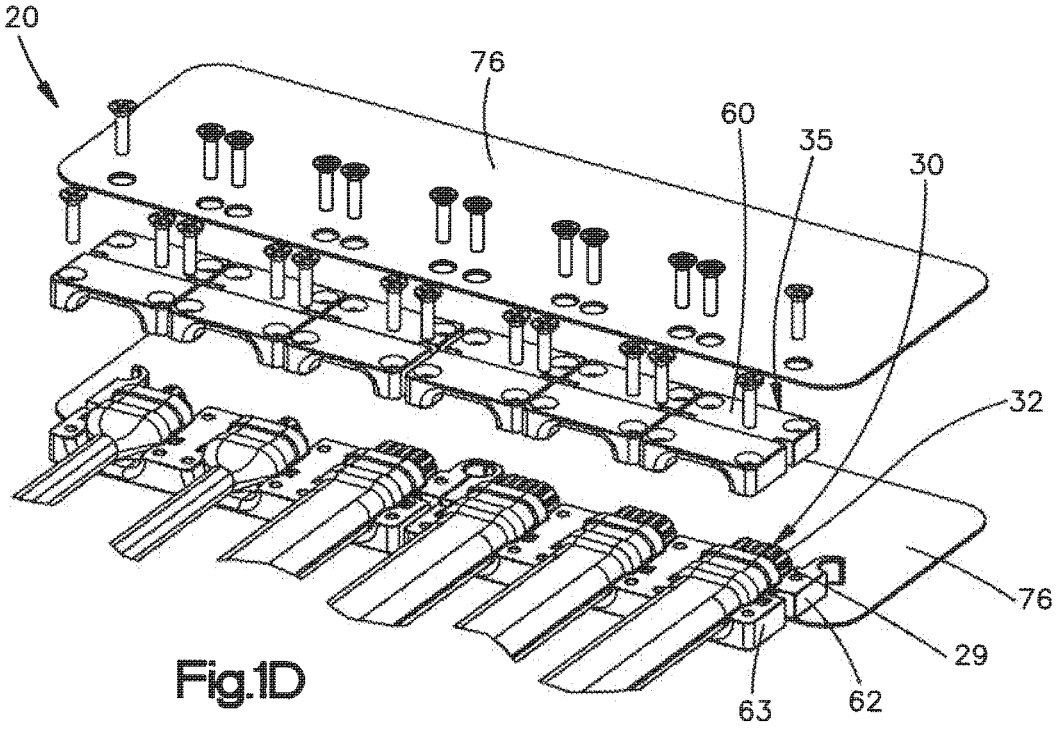
FIG. 1D is an exploded perspective view of the electrical connector system illustrated in FIG. 1A, showing one of the electrical connector modules including an electrical connector, it being appreciated that all electrical connector modules can include an electrical connector.

Referring now to FIGS. 1C-1D, each of the electrical connector modules 22 can further include a strain relief assembly 28. The strain relief assembly 28 includes a first retention member 33 that is disposed inside the electrically conductive sleeve 32, and at least one second retention member 35 that is disposed outside the electrically conductive sleeve 32. Thus, the electrically conductive sleeve 32 is disposed between the first and second retention members 33 and 35, respectively. Further, the strain relief assembly 28 is configured such that the electrically conductive sleeve 32 is captured between the first and second retention members 33 and 35. It should be appreciated that the strain relief assembly 28 can apply a compressive retention force to the electrically conductive sleeve 32 without applying the compressive retention force to the conductive cables 29. As a result, when a tensile force is applied to the electrically conductive sleeve 32, the tensile force is transferred to the first and second retention members 33 and 35 of the strain relief assembly 28, and absorbed by the first and second retention members 33 and 35 of the strain relief assembly 28. Accordingly, the tensile force is not transferred to the conductive cables 29. Thus, it can be said that the strain relief assembly 28 is configured to isolate the conductive cables 29 from the electrically conductive sleeve 32 with respect to a tensile force in the longitudinal direction L.

The first retention member 33 of the strain relief assembly 28 can be configured as a ferrule 56 that is disposed inside the electrically conductive sleeve 32. The ferrule 56 can be a one-piece or a two-piece structure, or can be otherwise constructed as desired. The electrically conductive sleeve 32 extends over at least a portion of the ferrule 56. For instance, the electrically conductive sleeve 32 extends over an entirety of the ferrule 56. Accordingly, the ferrule 56 can be disposed between the electrically conductive sleeve 32 and the conductive cables 29 that extend through the ferrule 56. The ferrule 56 can be dielectric or electrically insulative, and can be made from any suitable material as desired, such as a plastic. The electrically conductive sleeve 32 overlaps at least a portion of the ferrule 56 so as to define a region of overlap 58. The region of overlap 58 is defined as a region of the respective electrical connector module 22 where the electrically conductive sleeve 32 overlaps the ferrule 56. The electrically conductive sleeve 32 can extend along the ferrule 56 without overlapping itself. Thus, in accordance with one example, a straight line extending out from a select location in the radial direction spaced entirely outboard of the electrically conductive sleeve 32 passes through the ferrule 56 and only passes through the electrically conductive sleeve 32 one time. The select location is disposed inside the electrically conductive sleeve 32. For instance, the select location can be defined by any of the conductive cables 29 or any interstice between the conductive cables 29. It will be appreciated that the longitudinal direction L can extend along a straight direction at the region of overlap 58.

The second retention member 35 of the strain relief assembly 28 can include at least one retention plate that is configured to be urged toward the ferrule 56 in the radial direction to thereby compress the electrically conductive sleeve 32 between the at least one retention plate and the ferrule 56. The at least one retention plate can define at least one surface that compresses the electrically conductive sleeve 32 between the at least one retention surface and the ferrule 56. For instance, the at least one retention plate can include a first retention plate 60 and a second retention plate 62 that are each configured to be placed over respective first and second portions of the electrically conductive sleeve 32. The first retention plate 60 can define a first retention surface 61, and the second retention plate 62 can define a second retention surface 63. The first and second retention surfaces 61 and 63 can face the ferrule 56. The first and second retention plates 60 and 62 can each be urged toward the ferrule 56 in the radial direction, so as to bring the first and second retention surfaces 61 and 63 toward each other to a compressed position. The first and second retention plates 60 and 62 can be oriented such that the first and second retention surfaces 61 and 63 face each other. When the first and second retention plates 60 and 62 are in the compressed position, a first portion of the electrically conductive sleeve 32 can be compressed between the ferrule 56 and the first retention plate 60, and a second portion of the electrically conductive sleeve 32 can be compressed between the ferrule 56 and the second retention plate 62. The first and second portions of the electrically conductive sleeve 32 can be disposed at the region of overlap 58, and can be opposite each other along the radial direction.

In one embodiment, the first and second retention plates 60 and 62 are separate from each other, and can be fastened to each other in the compressed position. For instance, the strain relief assembly 28 can include at least one fastener that secures the first and second retention plates 60 and 62 to each other. Alternatively, the first and second retention plates 60 and 62 can be monolithic with each. In one example, the first and second retention plates 60 and 62 can be hingedly attached to each other. The hinge can be monolithic with the first and second retention plates 60 and 62, or can be a separate member that hingedly secures the first and second retention plates 60 and 62 to each other.

The ferrule 56 can define surface texture that engages complementary surface texture of at least one or both of the retention plates 60 and 62 that interferes with each other so as to prevent relative movement between the ferrule 56 and either or both of the first and second retention plates 60 and 62 along the longitudinal direction L. For instance, the surface texture of the ferrule 56 can define at least one projection or at least one recess configured to interlock with a complementary at least one recess or at least one projection, respectively, of at least one or both of the first and second retention plates 60 and 62. For instance, the ferrule 56 can include a plurality of projections 64 and recesses 66 spaced from each other along the longitudinal direction L. The projections 64 and recesses 66 can be alternatingly arranged along the longitudinal direction L. The projections 64 and recesses 66 can extend into an outer surface of the ferrule 56 along the radial direction. Further, the ferrule 56 can define a first plurality of the projections 64 and recesses 66 configured to interlock with the first retention plate 60. The ferrule 56 can further define a second plurality of the projections 64 and recesses 66 that are configured to interlock with the second retention plate 62.

The surface texture of the first retention plate 60 can define a plurality of projections 68 and recesses 70 spaced from each other along the longitudinal direction. The projections 68 and recesses 70 can be defined by the first retention surface 61. At least one or more of the projections 68 are configured to be received in a complementary at least one or more of the recesses 66 of the ferrule 56, with the electrically conductive sleeve 32 captured therebetween. For instance, the projections 68 can be configured to interlock with the complementary at least one or more of the recesses 66 of the ferrule 56 with the electrically conductive sleeve 32 captured therebetween. Likewise, the recesses 70 are configured to receive the projections 64 of the ferrule 56, with the electrically conductive sleeve 32 captured therebetween. For instance, the recesses 70 and the projections 64 are configured to interlock with each other, with the electrically conductive sleeve 32 captured therebetween. It should be appreciated that the Similarly, the surface texture of the second retention plate 62 can define a plurality of projections 72 and recesses 74 spaced from each other along the longitudinal direction. The projections 72 and recesses 74 can be defined by the second retention surface 63. At least one or more of the projections 72 are configured to be received in a complementary at least one or more of the recesses 66 of the ferrule 56, with the electrically conductive sleeve 32 captured therebetween. For instance, the projections 72 can be configured to interlock with the complementary at least one or more of the recesses 66 of the ferrule 56 with the electrically conductive sleeve 32 captured therebetween. Likewise, the recesses 74 are configured to receive the projections 64 of the ferrule 56, with the electrically conductive sleeve 32 captured therebetween. For instance, the recesses 74 and the projections 64 are configured to interlock with each other, with the electrically conductive sleeve 32 captured therebetween.

The strain relief assembly 28 can be constructed by moving or pulling the electrically conductive sleeve 32 over the ferrule 56 in the longitudinal direction L, thereby defining the region of overlap 58. Next, the first and second retention plates 60 and 62 are positioned such that the first and second retention surfaces 61 and 63 are aligned with the ferrule 56, and thus are also aligned with the electrically conductive sleeve 32 over at least a portion of the region of overlap 58. Next, the first and second retention plates 60 and 62 are moved to the compressed position, such that the electrically conductive sleeve 32 is captured between the ferrule 56 and at least one or both of the first and second retention plates 60 and 62. It should be appreciated that the respective recesses and projections of the retention plates 60 and 62 can interlock with the complementary projections and recesses of the ferrule 56 as the first and second retention plates 60 and 62 are moved to the compressed position. Finally, the first and second retention plates 60 and 62 can be secured in the compressed position. In one embodiment, the electrically conductive sleeve 32 is retained only at a location between the ferrule 56 and the at least one or both of the first and second retention plates 60 and 62.

It should be appreciated that the first retention plate 60 can define a plurality of first retention surfaces 61 arranged along a first row, and the second retention plate 62 can define a plurality of second retention surfaces 63 arranged along a second row, each configured to compress against a complementary ferrule 56 with a corresponding electrically conductive sleeve 32 of a respective cable assembly 26 captured therebetween. The first and second rows can be oriented in a lateral direction A that is perpendicular to the longitudinal direction L.

In one application illustrated in FIG. 1A, the electrical connector system 20 can include a pair of opposed substrates 76 that can be oriented parallel to each other, and secured to opposed ends of the second retention member 35. For instance, the substrates 76 can each be planar along a respective plane defined by the longitudinal direction L and the lateral direction A. The substrates 76 can be electrically conductive. Alternatively, the substrates 76 can be electrically nonconductive. Alternatively still, the substrates can be configured as printed circuit boards. The substrates 76 can be spaced from each other along a transverse direction T that is perpendicular to the lateral direction A and the longitudinal direction L. In one example, the first and second retention plates 60 and 62 can be adjacent each other along the transverse direction T. For instance, a first one of the substrates 76 can be mounted to the first retention plate 60, and a second one of the substrates 76 can be mounted to the second retention plate 62. The electrical connectors 24 can be disposed between the substrates 76, and can for instance be attached to one of the substrates 76. For instance, a first or rear end of the substrates 76 can be attached to the first and second retention plates 60 and 62, and the electrical connectors 24 can be disposed at a front end of the substrates 76 opposite the rear end along the longitudinal direction L. The bundle of electrical cables 29 can extend from the electrical component 23 to the sleeve 32 between the first and second substrates 76. The sleeve 32 can terminate at the rear end of the substrates 76, for instance between the first and second retention plates 60 and 62. Alternatively, the sleeve 32 can surround the bundle of electrical cables 29 between the second retention member 35 and the electrical component 23. For instance, the sleeve 32 can surround the bundle of electrical cables 29 from the second retention member 35 to the electrical component 23.

Figures 2A, 2B:
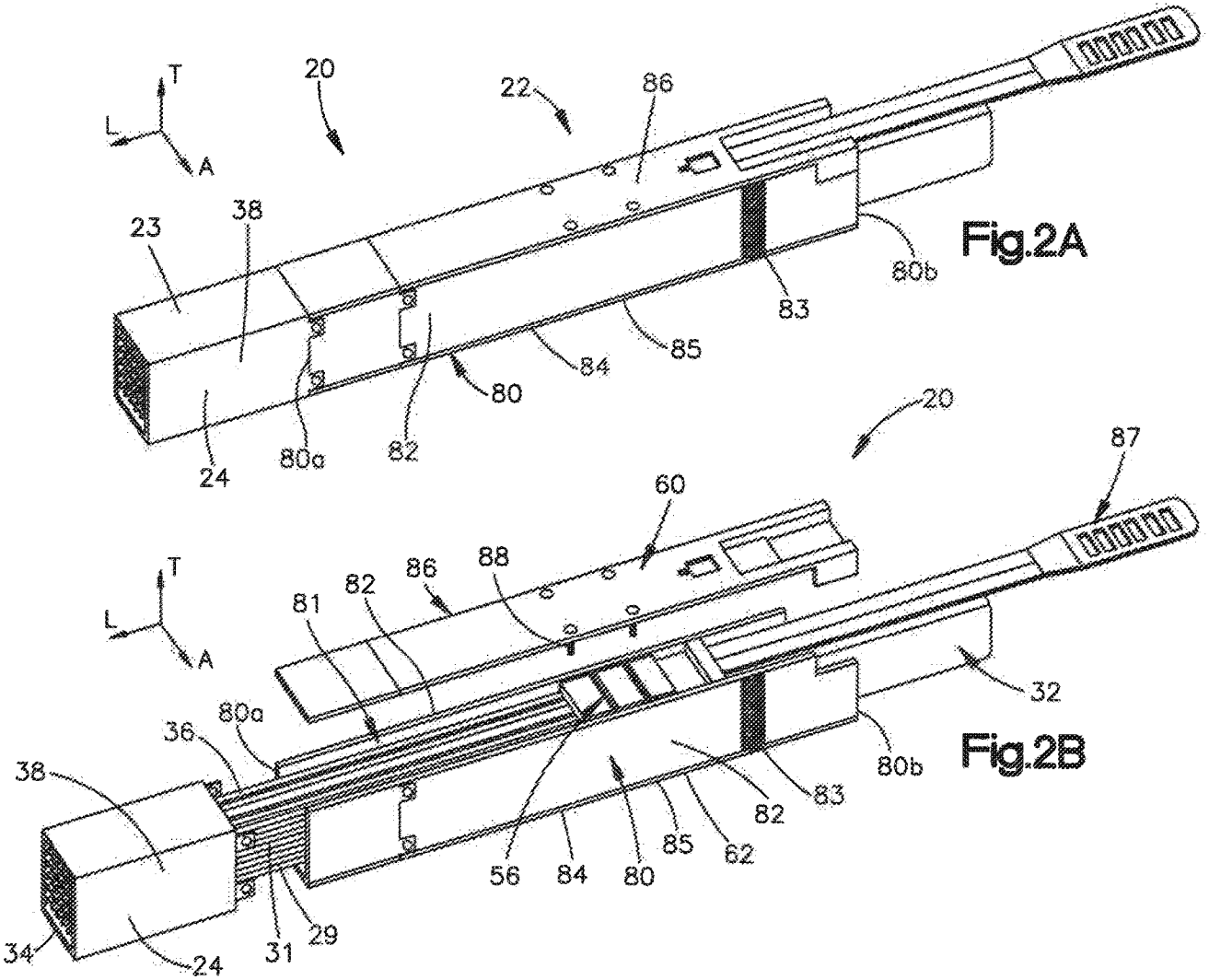
FIG. 2A is a perspective view of an electrical connector module constructed in accordance with another embodiment.
FIG. 2B is an exploded perspective view of the electrical connector module illustrated in FIG. 2A, with a portion of the braid removed for the purposes of illustration so as to show the ferrule.
Figure 2C:
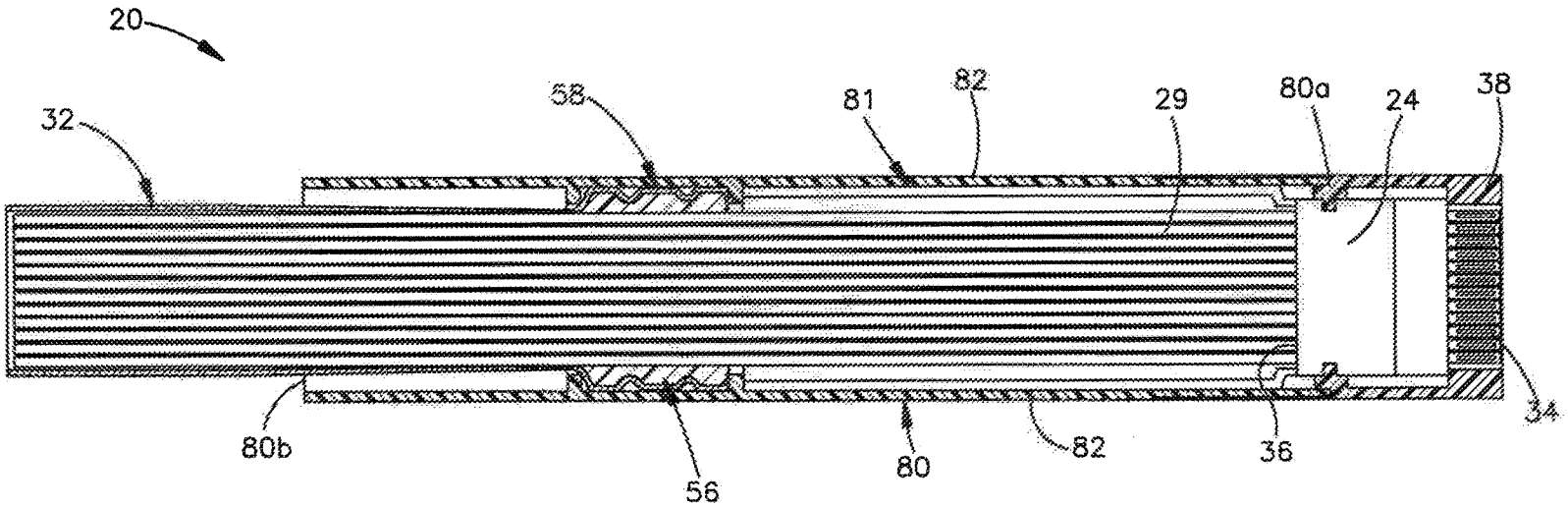
FIG. 2C is a cross-sectional view of the electrical connector module illustrated in FIG. 2A.
Figure 2D:
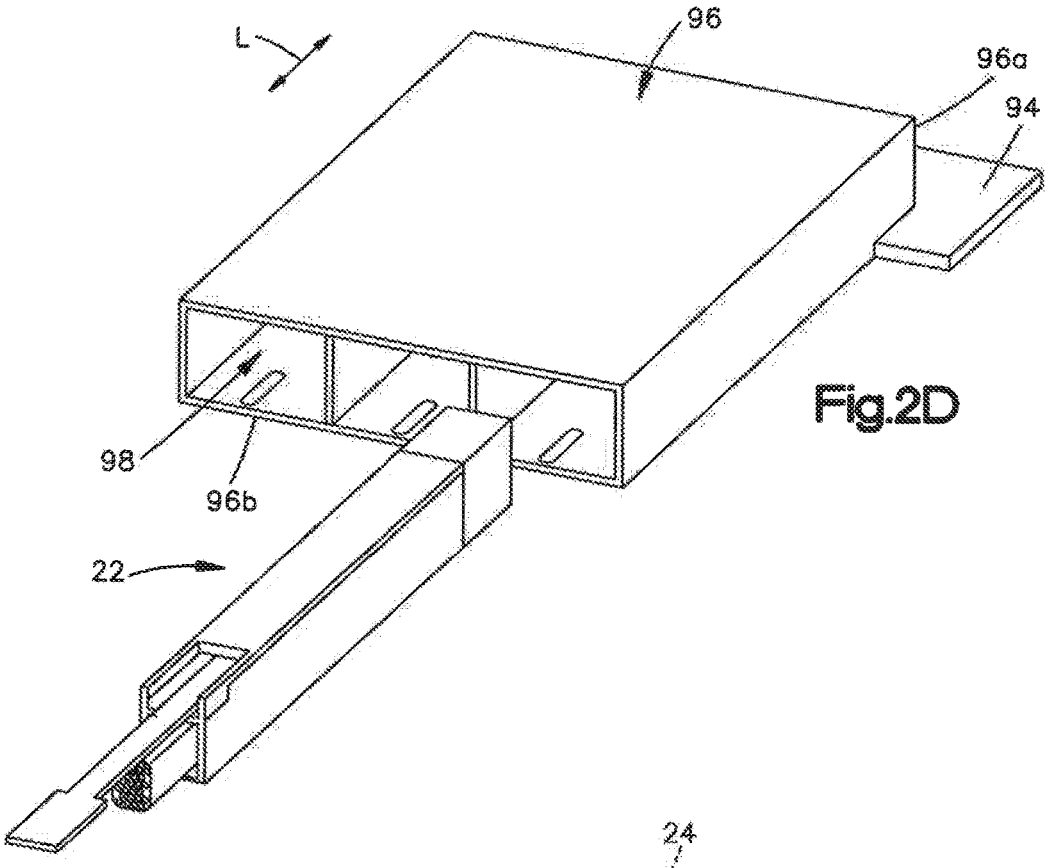
FIG. 2D is a perspective views of an electromagnetic interference shielding cage, and a plurality of complementary electrical connectors disposed in the cage and mounted to a printed circuit board, the shielding cage configured to receive a plurality of the electrical connector modules as illustrated in FIG. 2A so as to mate the modules with respective ones of the complementary electrical connectors.
Figure 2E:
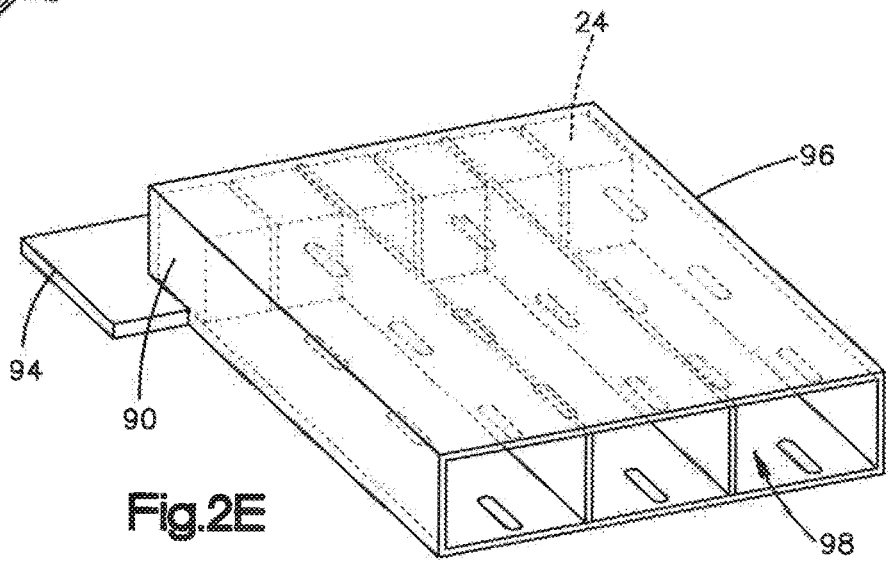
FIG. 2E is another perspective view of the electromagnetic interference shielding cage, shown transparent so as to illustrate a plurality of complementary electrical connectors mounted to a printed circuit board.

Referring now to FIGS. 2A-2C, in another application, the connector system 20, and thus the electrical connector module 22, can include an electrically conductive casing 80 that includes a pair of electrically conductive side walls 82 that are opposite each other along the lateral direction A, an electrically conductive bottom wall 84 that extends between the side walls 82, and an electrically conductive top wall 86 that extends between the side walls 82 and is opposite the bottom wall 84 along the transverse direction T. The side walls 82, the bottom wall 84, and the top wall 86 can be made from any suitable electrically conductive material as desired, such as a metal. One or more up to all of the side walls 82, the bottom wall 84, and the top wall 86 can be monolithic with each other. Alternatively, one or more up to all of the side walls 82, the bottom wall 84, and the top wall 86 can be separate from each other and attached to each other. For instance, in one example, the bottom wall 84 and the side walls 82 can be monolithic with each other so as to define a monolithic body 85, and the top wall 86 can be separate from the monolithic body and secure to the monolithic body 85 in any manner desired. For instance, in one example, the casing 80 can include at least one fastener 88 such as a plurality of fasteners 88 that attach the top wall 86 to the monolithic body 85, thereby securing the first and second retention plates 60 and 62 to each other as described in more detail below. It should be appreciated that while the monolithic body 85 includes the side walls 82 and the bottom wall 84 in one embodiment, the monolithic body 85 can include any one or more up to all of the side walls 82 and the bottom wall 84 that are monolithic with each other. The remaining walls can be secured to the monolithic body 85 in any manner desired.

The side walls 82, the top wall 86, and the bottom wall 84 can combine to define an interior void 81 of the casing 80. The casing 80 defines a front end 80*a* and a rear end 80*b* that is opposite the front end 80*a* along the longitudinal direction L. Each of the front end 80*a* and the rear end 80*b* can define a respective opening into the interior void 81. For instance, each of the front end 80*a* and the rear end 80*b* can define respective openings into the interior void 81 along the longitudinal direction L. Each of the side walls 82, the top wall 86, and the bottom wall 84 can extend from the front end 80*a* to the rear end 80*b*. The casing 80 can define the interior void that extends from the front end 80*a* to the rear end 80*b*. The electrical connector 24 can be supported at the front end 80*a* of the casing 80, such that the bundle 30 of electrical cables extends from the electrical connector 24, through the casing 80 substantially along the longitudinal direction L, through the ferrule 56, and out the rear end 80*b*. The electrically conductive sleeve 32 can extend into the rear end 80*b* along a forward direction toward the front end 80*a*.

The electrically conductive sleeve 32 can be moved or pulled over the ferrule 56 in the longitudinal direction L, thereby defining the region of overlap 58 as described above. The first and second retention plates 60 and 62 can be defined by the casing 80. For instance, the first retention plate 60 can be defined by one of the side walls 82, the bottom wall 84, and the top wall 86. The second retention plate 62 can be defined by a different one of the side walls 82, the bottom wall, and the top wall 86. The first and second retention plates 60 and 62 can be opposite each other in one example. For instance, the first retention plate 60 can be defined by one of the bottom wall 84 and the top wall 86, and the second retention plate 62 can be defined by the other of the bottom wall 84 and the top wall 86. In one example, the first retention plate 60 can be defined by the top wall 86, and the second retention plate 62 can be defined by the bottom wall 84. Thus, the first and second retention plates 60 and 62 can be spaced from each other along the transverse direction T. Accordingly, the retention force applied to the electrically conductive sleeve 32 by retention plates 60 and 62 and the ferrule 56 can be applied in the transverse direction T. Alternatively, the first retention plate 60 can be defined by one of the side walls 82, and the second retention plate 62 can be defined by the other of the side walls 82. Thus, the first and second retention plates 60 and 62 can be spaced from each other along the lateral direction A. Thus, the retention force applied to the electrically conductive sleeve 32 by the retention plates 60 and 62 and the ferrule 56 in the lateral direction A. While the first and second retention plates 60 and 62 can be opposite each other as described herein, they can be offset from each other any amount as desired so as to combine with the ferrule 56 to apply the respective compressive retention force to the electrically conductive sleeve 32.

As described above, the surface texture of the ferrule 56 can interlock with surface texture of one or both of the first and second retention plates 60 and 62 so as to prevent relative movement of the one or both of the first and second retention plates 60 and 62 with respect to the ferrule 56 in the longitudinal direction L. For instance, the first and second retention plates can include projections 68 that are received in the recesses 66 of the ferrule 56. It should be appreciated, of course, that the surface texture of the ferrule 56 and the retention plates 60 and 62 can interlock in any suitable alternative embodiment as desired, for instance, as described above.

Referring now to FIGS. 2A-2E, an electrical connector assembly can include the electrical connector system 20, which includes the at least one electrical connector module 22, and a complementary electrical component 90 that is configured to mate with the electrical component 23 of the at least one electrical connector module 22. For instance, the electrical connector system 20 can include a plurality of the electrical connector modules 22, and the electrical connector assembly can include a plurality of complementary electrical components 90 configured to mate with respective ones of the electrical connector modules 22. In particular, the complementary electrical components 90 are configured to mate with respective ones of the electrical components 23 of the corresponding electrical connector module 22. When the complementary electrical components 90 are configured to mate the electrical components 23, the complementary electrical components 90 are placed in communication with the electrical cables 29. The electrical connector assembly can further include a substrate 94, which can be configured as a printed circuit board. When the complementary electrical components 90 are mounted to the substrate 94 and mated with respective ones of the electrical components 23, the electrical components 23 are placed in communication with the substrate 94. It should be appreciated that the complementary electrical components 90 can be configured as any suitable electrical connector or other electrical component as desired. When the electrical components 90 are configured as electrical connectors, they can include a dielectric or electrically insulative connector housing, and a plurality of electrical contacts that are configured to be mounted to the substrate 94, and mated to complementary ones of the electrical contacts of the electrical connectors 24 to which they are mated.

The electrical connector assembly can further include an electrically conductive cage 96 that defines a front end **96*a* and a rear end 96*b* that is opposite the front end 96*a* along the longitudinal direction L. The complementary electrical components 90 can be supported at the front end 96*a*. The cage 96 can define a plurality of receptacles 98 that extend from the front end 96*a* to the rear end 96*b*, such that the receptacles 98 are open to the front end 96*a*. Thus, the receptacles 98 are open to the complementary electrical component 90. The electrical connector modules 22 can be inserted into respective ones of the receptacles 98 along the forward direction from the rear end 96*b* to the front end 96*a* until the electrical component 23 mates with the complementary electrical component 90 in the manner described above. The casing 80 can support electrically conductive springs 83 that project out from the body 85 so as to make contact with the electrically conductive cage 96 when the electrical connector modules 22 are inserted into the respective ones of the receptacles 98. The electrical connector modules 22 can include a pull tab 87 that extends rearward, opposite the forward direction from the body 85. A tensile force can be applied to the pull tab 87 to apply a removal force that causes the electrical connector module to be unmated from the complementary electrical component 90, and removed from the receptacle 98**.

It should be appreciated that methods can be provided for providing strain relief to the bundle 30 of cables 29 that are surrounded by the electrically conductive sleeve 32. Each of the cables can include one of the electrical insulators 31 at least one electrical conductor surrounded by the one of the electrical insulators 31 as described above. For instance, the at least one electrical conductor can include a pair of electrical signal conductors and a drain wire that are each separately insulated. The method can include the step of inserting the bundle 30 of cables 29 through the ferrule 56 along the longitudinal direction L, wherein the bundle 30 of cables 29 extends from an electrical component. The method can further include the step of sliding the electrically conductive sleeve 32 over the ferrule 56 in a forward direction without overlapping the electrically conductive sleeve 32 over itself in a rearward direction opposite the forward direction, wherein the forward and rearward directions are along the longitudinal direction. The method can further include the step of securing at least one retention member relative to the ferrule 56 so as to apply a compressive retention force to the electrically conductive sleeve 32 between the ferrule 56 and the at least one retention member. The method can further include the step of interlocking surface texture of the ferrule 56 with surface texture of the at least one retention member so as to limit movement of the at least one retention member relative to the ferrule 56 along the longitudinal direction L.

The interlocking step can include the step of capturing the electrically conductive sleeve 32 between the surface texture of the ferrule 56 and the surface texture of the at least one retention member. The securing step can include the step of securing the first and second retention plates 60 and 62, respectively, with respect to each other so as to capture the electrically conductive sleeve 32 between the ferrule 56 and each of the first and second retention plates 60 and 62, respectively. The method can further include the step of positioning the first and second retention plates 60 and 62 opposite each other. The method can further include the step of supporting the first and second retention plates 60 and 62 at a rear end of the first and second substrates 76 as illustrated in FIG. 1A, and positioning the electrical component 23 at a front end of the first and second substrates 76 between the first and second substrates 76, such that the electrical cables 29 extend from the electrical component 23 to the ferrule 56. The method can further include the step of supporting a plurality of the electrical components 23 at the front end of the first and second substrates 76.

As illustrated in FIGS. 2A-2C, the method can further include the step of supporting the electrical component 23 at a front end of an electrically conductive casing 80, such that the casing 80 defines the at least one retention member. The method can further include the step of supporting the ferrule 56 in the casing 80, such that the electrically conductive sleeve 32 extends out a rear end of the casing 80 opposite the front end of the casing. Referring to FIGS. 2A-2E, the method can further include the step of inserting the casing 80 into one of the electrically conductive cages 96 in the forward direction until the electrical component 23 mates with a complementary electrical component 90 supported by the cage 96. The method can further include the step of placing the casing 80 in electrical communication with the cage 96. For instance, the method can include the step of contacting the spring 83 supported by the casing 80 with the cage 96.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the invention as described herein, and changes may be made without departing from the spirit and scope of the invention, for instance as set forth by the appended claims.

What is claimed:

1. An electrical connector module comprising:

a casing comprising a front end and a rear end;

an electrical component having a mating end and a mounting end, and a bundle of conductive cables that extend out from the mounting end along a length, wherein the electrical component is mounted within the casing with the mating end at the front end of the casing;

a strain relief assembly, mounted to the casing separated from the electrical component along the length, the strain relief assembly comprising:

an electrically conductive sleeve;

a ferrule disposed between the bundle and the electrically conductive sleeve, such that the bundle extends through the ferrule, wherein the electrically conductive sleeve surrounds the bundle along at least a portion of the length, and overlaps at least a portion of the ferrule at a region of overlap, and does not overlap itself; and at least one retention member that is positioned at the region of overlap, such that the electrically conductive sleeve extends to a location between the ferrule and the at least one retention member at the region of overlap, wherein the at least one retention member is compressed toward the ferrule so as to apply a compressive retention force to the electrically conductive sleeve between the ferrule and the at least one retention member.

2. The electrical connector module as recited in claim 1, wherein a straight line extending out from a select location in the radial direction passes through the ferrule and only passes through the electrically conductive sleeve one time.

3. The electrical connector module as recited in claim 2, wherein the select location is disposed inside the electrically conductive sleeve.

4. The electrical connector module as recited in claim 1, wherein the bundle extends through the ferrule along a longitudinal direction, and the ferrule and the at least one retention member defines surface texture that interlocks so as to limit movement of the at least one retention member relative to the ferrule along the longitudinal direction.

5. The electrical connector module as recited in claim 4, wherein the surface texture interlocks with the electrically conductive sleeve captured therebetween.

6. The electrical connector module as recited claim 1, wherein the ferrule is electrically nonconductive.

7. The electrical connector module as recited claim 1, wherein the conductive cables are electrically conductive.

8. The electrical connector module as recited claim 1, wherein the conductive cables are optically conductive.

9. The electrical connector module as recited claim 1, wherein the at least one retention member comprises first and second retention plates disposed opposite each other.

10. The electrical connector module as recited claim 1, wherein the first and second retention plates combine to surround the electrically conductive sleeve.

11. An electrical connector system comprising:

the electrical connector module as recited in claim 1; and wherein the casing has walls comprising first and second substrates disposed such that the electrical component is between the first and second substrates.

12. The electrical connector system as recited in claim 11, wherein the casing is electrically conductive.

13. The electrical connector system as recited in claim 12, wherein the conductive cables extend from the connector, between the first and second substrates, to the ferrule.

14. The electrical connector system as recited in claim 13, wherein the electrical component is a first electrical connector, and the electrical connector system further comprises a plurality of like electrical connectors disposed between the first and second substrates.

15. An electrical connector system comprising:

the electrical connector module as recited in claim 1;

wherein the casing is an electrically conductive casing that defines an interior void, wherein the at least one retention member is defined by the casing, the ferrule is disposed in the interior void, and the electrically conductive sleeve extends out the rear end.

16. The electrical connector system as recited in claim 15, wherein the at least one retention member comprises first and second retention plates disposed opposite each other and defined by the casing.

17. The electrical connector system as recited in claim 16, wherein the first and second retention plates combine to surround the electrically conductive sleeve.

18. The electrical connector system as recited in claim 16, wherein the electrically conductive casing comprises conductive springs that are configured to contact an electrically conductive cage when the casing is inserted into the cage.

19. An electrical connector assembly comprising:

the electrical connector system as recited in claim 15;

the electrically conductive cage; and a complementary electrical component supported at a front end of the cage, wherein the electrical connector system is configured to be inserted into the cage from a rear end of the cage toward the front end until the electrical component mates with the complementary electrical component.

20. A method for providing strain relief to a bundle of cables surrounded by an electrically conductive sleeve, the method comprising the steps of:

forming a strain relief assembly by:

inserting the bundle of cables through a ferrule along a longitudinal direction, wherein the bundle of cables extends from an electrical component;

sliding the electrically conductive sleeve over the ferrule in a forward direction without overlapping the electrically conductive sleeve over itself in a rearward direction opposite the forward direction, wherein the forward and rearward directions are along the longitudinal direction; and securing at least one retention member relative to the ferrule so as to apply a compressive retention force to the electrically conductive sleeve between the ferrule and the at least one retention member; and securing the electrical component to a first end of a casing and securing the strain relief assembly to the casing, separated from the electrical component along the length.

21. The method as recited in claim 20, further comprising the step of interlocking surface texture of the ferrule with surface texture of the at least one retention member so as to limit movement of the at least one retention member relative to the ferrule along a longitudinal direction that includes the forward direction and the rearward direction.

22. The method as recited in claim 21, wherein the interlocking step comprises capturing the electrically conductive sleeve between the surface texture of the ferrule and the surface texture of the at least one retention member.

23. The method as recited in claim 20, wherein the securing step comprises securing first and second plates with respect to each other so as to capture the electrically conductive sleeve between the ferrule and each of the first and second plates.

24. The method as recited in claim 23, further comprising positioning the first and second plates opposite each other.

25. The method as recited in claim 20, wherein securing the electrical component to a first end of a casing and securing the strain relief assembly to the casing comprises supporting the first and second plates at a rear end of first and second substrates, the first and second substrates comprising portions of the casing, and positioning the electrical component at a front end of the first and second substrates between the first and second substrates, wherein the electrical cables extend from the electrical component to the ferrule.

26. The method as recited in claim 25, further comprising the step of supporting a plurality of electrical components at the front end.

27. The method as recited in claim 20, wherein:

the casing is an electrically conductive casing, and the casing defines the at least one retention member; and the ferrule is supported in the casing, such that the electrically conductive sleeve extends out a rear end of the casing opposite the front end.

28. The method as recited in claim 27, further comprising the step of inserting the casing into an electrically conductive cage in the forward direction until the electrical component mates with a complementary electrical component supported by the cage.

29. The method as recited in claim 28, further comprising the step of contacting with the cage a spring that extends out from the casing.

* * * * *